United States Patent [19]

Dimijian

[11] Patent Number: 4,899,548

[45] Date of Patent: Feb. 13, 1990

[54] ICE FORMING APPARATUS

[75] Inventor: Berge A. Dimijian, 919 S. Highland Ave., Los Angeles, Calif. 90036

[73] Assignees: Berge A. Dimijian; Beverly Rodeo Development Corporation, both of Los Angeles, Calif. ; a part interest

[21] Appl. No.: 311,765

[22] Filed: Feb. 17, 1989

[51] Int. Cl.[4] ..... F25C 1/12

[52] U.S. Cl. ..... 62/138; 62/347

[58] Field of Search ..... 62/347, 348, 352, 138

[56] References Cited

U.S. PATENT DOCUMENTS

| | | | |
|---|---|---|---|
| 2,114,642 | 4/1938 | West | 62/352 X |
| 2,674,858 | 4/1954 | Magnuson et al. | 62/347 |
| 2,900,804 | 8/1959 | Rising | 62/348 X |
| 2,978,882 | 4/1961 | Bollefer | 62/347 |
| 3,053,058 | 9/1962 | Kocher | 62/347 |
| 3,220,214 | 11/1965 | Cornelius | 62/347 |
| 3,254,501 | 6/1966 | Brysselbout | 62/347 |
| 3,280,585 | 10/1966 | Lowe | 62/347 |
| 3,338,065 | 8/1967 | Ashley | 62/352 X |
| 3,380,261 | 4/1968 | Hendrix et al. | 62/352 X |
| 3,433,030 | 3/1969 | Jacobs | 62/186 |
| 4,045,979 | 9/1977 | Mazzini | 62/348 X |
| 4,572,785 | 2/1986 | Braaten | 210/181 |

*Primary Examiner*—William E. Tapolcai

*Attorney, Agent, or Firm*—William W. Haefliger

[57] ABSTRACT

Ice making apparatus includes a plate forming a plurality of through openings, the plate having an under surface facing downwardly, a plurality of evaporator tips projecting downwardly from said openings, said tips consisting of heat conductive metal; there being downwardly tapering thermal isolators surrounding the tips proximate the plate, first means for supplying refrigerant fluid to extract heat upwardly from at least some of the tips and thereby cool them to ice forming temperature, and second means to spray water onto the under surface of the plate to drain down said isolators onto the tips, whereby ice progressively forms on the tips, and the tips may be subsequently heated to effect release of the ice from the tips to drop downwardly, for harvesting.

10 Claims, 3 Drawing Sheets

ICE FORMING APPARATUS

BACKGROUND OF THE INVENTION

This invention relates generally to formation of ice pieces, and more particularly to simple, reliable, low cost apparatus to automatically produce ice pieces.

Prior apparatus to accomplish the above objective has been characterized by excessive cost, and complexity leading to unreliability. There is need for improved apparatus, which is simple and effective, to produce ice, automatically, with minimum parts.

SUMMARY OF THE INVENTION

It is a major object of the invention to provide improved apparatus meeting the above need. Such apparatus typically includes (a) a plate forming a plurality of through openings, the plate having an under surface facing downwardly, (b) a plurality of evaporator tips projecting downwardly from said openings, said tips consisting of heat conductive metal, (c) there being downwardly tapering thermal isolators surrounding the tips proximate the plate, (d) first means for supplying refrigerant fluid to extract heat upwardly from at least some of the tips and thereby cool them to ice forming temperature, (e) second means to spray water onto the under surface of the plate to drain down said isolators onto the tips, whereby ice progressively forms on the tips, and the tips may be subsequently heated to effect release of the ice from the tips to drop downwardly, for harvesting.

As will be seen, the tips are typically integral with or carried by the plate, are hollow, and the first means typically includes ducting positioned to extend over the tips so that refrigerant flows in heat extracting relation with the tips.

It is yet another object to provide simple ice forming and releasing tips that have downwardly conical surfaces, the downwardly tapering isolators having surfaces extending closely about the tips, above the lowermost extents thereof, to prevent ice formed on the tips from clinging to the plate.

It is a further object to provide a system to alternately flow cold refrigerant and warm fluid to and through flow ducting, the warm fluid heating the tips to release ice that forms on them when refrigerant flows through the ducting.

Additional objects include the provision of a spray head located beneath said plate, and angled to direct the spray laterally and upwardly to impinge upon plate extents between the tips for drainage onto the tips; the provision of a chute located beneath the tips to receive the ice dropping off the tips and to direct the received ice toward a lower collection zone, and a housing extending about the ducting, plate, chute and said collection zone; and the provision of a sensor projecting toward a zone of ice formation adjacent one of the tips, and a valve operatively connected with the sensor to switch said supply of refrigerant, when ice forms to a thickness to contact said sensor, to supply warm refrigerant instead of cool refrigerant, and to switch said supply of refrigerant, when ice has released from the tips, to supply cool refrigerant instead of warm refrigerant. These and other objects and advantages of the invention, as well as the details of an illustrative embodiment, will be more fully understood from the following specification and drawings, in which:

DRAWING DESCRIPTION

DETAILED DESCRIPTION

Figure 1:
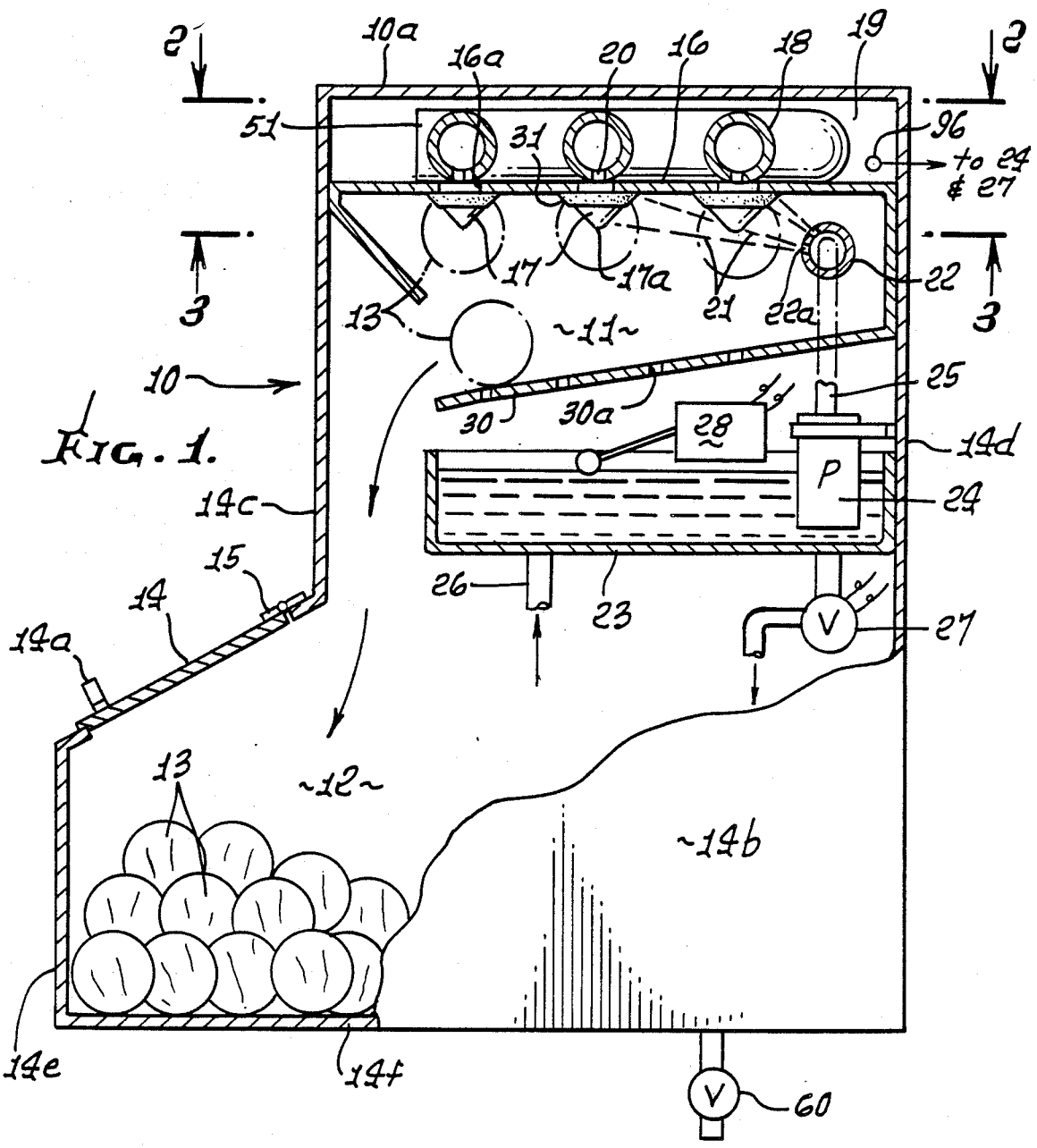
FIG. 1 is an elevation in section showing apparatus embodying the invention.

In FIG. 1, a housing 10 surrounds an upper region 11 wherein ice is generated, and a lower region 12 wherein ice that has fallen from region 11 is collected or harvested. Ice pieces 13 in region 12 are accessible by lifting a door 14, hinge mounted to the housing, at 15. A door handle appears at 14*a*. Housing walls appear at 14*b*–14*e*.

Figure 3:
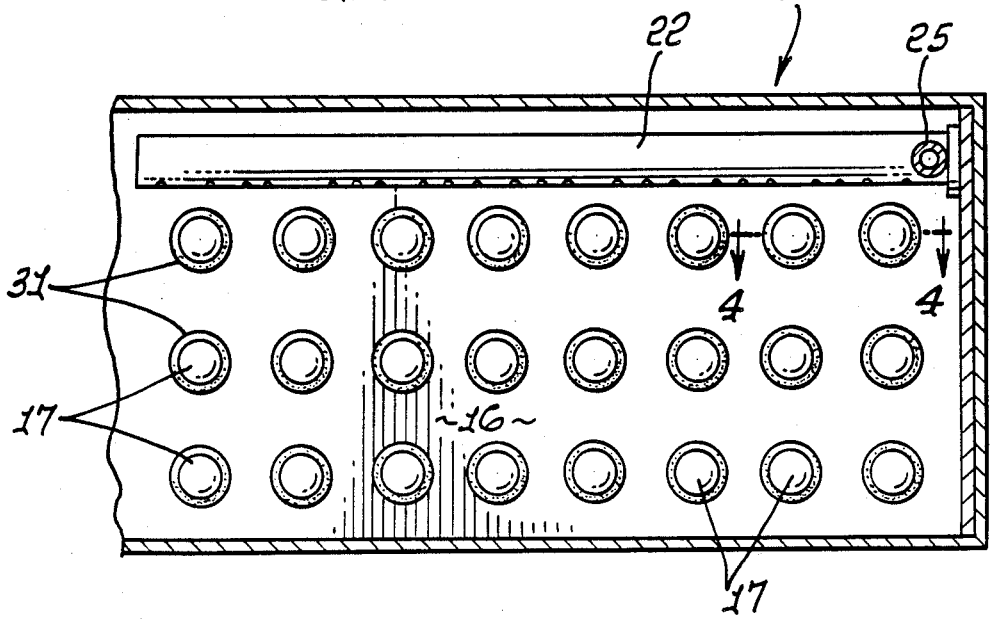
FIG. 3 is a view taken on lines 3—3 of FIG. 1.
Figure 4:
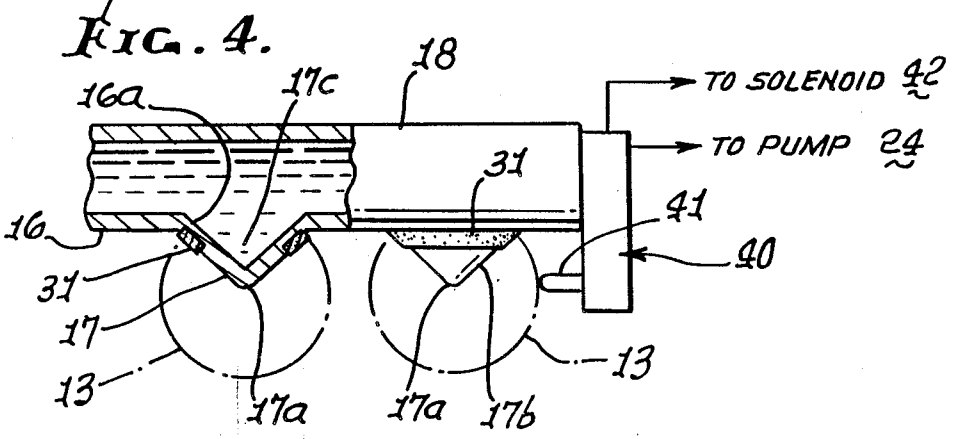
FIG. 4 is an enlarged fragmentary section taken on lines 4—4 of FIG. 3.

Located in region 11 is a horizontal plate 16, spaced below the top wall 10*a* of the housing. Plate 16 is carried by the housing, and supports a multiplicity of metallic tips 17, typically extending in rows and columns as seen in FIG. 3. The tips may be formed integrally with the plate 16, as seen in FIG. 4, and depend from the plate, to have lowermost apices at 17*a*. The tips typically have downwardly tapering, conical surfaces 17*b*, and are hollow as at 17*c* below openings 16*a* in the plate. If the tips are not part of the plate they are carried by the plate, as in FIG. 1. Refrigerant supply means in the form of ducts 18 extend in space 19 above plate 16 and below top wall 10*a*. Such ducts have lowermost openings 20 to communicate refrigerant 1 to the hollow interiors of the hollow tips, thereby to cool the tips to below ice forming temperature. In FIG. 4, the openings 20 coincide with openings 16*a*. A header 50 supplies refrigerant to the ducts, and a header 51 receives refrigerant from the ducts.

Second means is also provided to spray water streams 21 laterally and upwardly onto the underside of the plate 16. Such means is shown in the form of a spray nozzle or nozzles 22 below plate 16 and having an outlet or outlets 22*a* angled to direct the streams 21 as shown. Water is supplied to the nozzle or nozzles from a reservoir 23, and via a pump 24 and a line 25 leading from the pump to the nozzle or nozzles. Water is received into the reservoir via duct 26, and discharged to the exterior, as described in in FIG. 7. A control 28 for valve 27 and pump 24 is responsive to water level in the reservoir. See also FIG. 7. The reservoir is located beneath an inclined plate 30 acting as a chute to direct dropping ice pieces toward lower region 12, referred to above. Plate 30 is perforated at 30*a*, and may be a grid.

Located on the tips are downwardly tapering, thermal isolators 31, which may surround upper extents of the downwardly tapering tips, and are spaced above apices 17*a* as well as above downwardly tapering conical surfaces 17*b*. Surfaces 31 may have the form of cone frustums, for effectively preventing clinging of isolator ice to the plate 16. They may be formed by plastic, annular frustums bonded to the metallic isolators to be substantially surface flush therewith.

In operation, water sprayed onto the under surface of plate 16 between the tips drains down over the surfaces 31, and 17*b* in succession, toward apices 17*a*, forming ice pieces 13, generally spherically shaped due to the insulated frustum-shaped surfaces 31 which tend not to conduct heat from the draining water to the refrigerant, and which tend not to retain or hold the ice. Thus, the ice formed on the tips is primarily located and retained below the insulative rings 31, and clings to surfaces 17*b* as ice builds up; at the same time, the surfaces 31 and 17*b* are so shaped as to readily release the ice to drop downwardly, once the tips are warmed, as described below.

When the ice builds up to predetermined size, a sensor senses that build-up and effects stoppage of cold refrigerant supply to the tips, and substitutes flow of warm refrigerant fluid to the hollow interiors of the tips to warm them and quickly effect release of ice pieces. The The latter drop onto the chute or plate 30, which directs the ice to region 11. The ice pieces are of uniform shape, due to the functioning of surfaces 31 and the conical shape of the tips.

Figure 5:
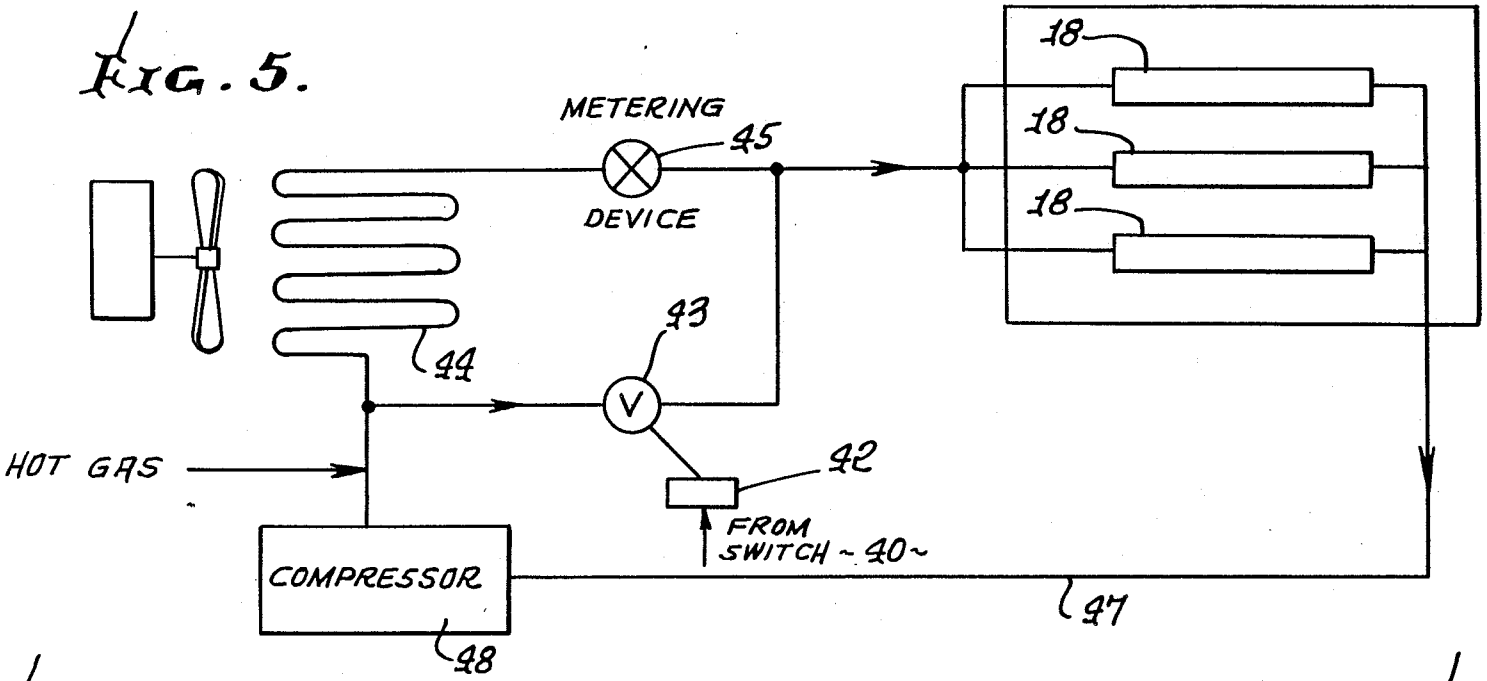
FIG. 5 is a refrigerant system flow diagram.

One form of sensor is indicated at 40 in FIG. 4 in the form of a switch having a plunger 42 that is pushed laterally as ice builds up, to close the switch. Referring to FIG. 5, the switch 40 controls a solenoid 42, which operates a valve 43 in the refrigerant system. When valve 43 is closed, compressed refrigerant passes to coil 44 wherein it is cooled and liquified, and then expands at 45 to refrigerating temperature, to flow as gas through the ducts 18 for refrigerating the tips 17, as described. The refrigerant then flows back at 47 to the compressor 48, completing the cycle. Pump 24 is also operating during this time.

When valve 43 is opened by switch 40, due to sensed ice build-up to desired size, warm compressed refrigerant gas flows directly to the ducts 18 to quickly release the ice from the tips, the response time being quite short. After such release, the sensor plunger 42 returns to extended position and causes switch 40 to operate solenoid to close valve 43, initiating the next ice build-up cycle. Any refrigerant liquid collecting in the hollow tips quickly evaporates to be swept out by refrigerant gas.

Any water draining to the bottom of the housing may be drained at 60, at housing bottom wall 14*f*.

Figure 6:
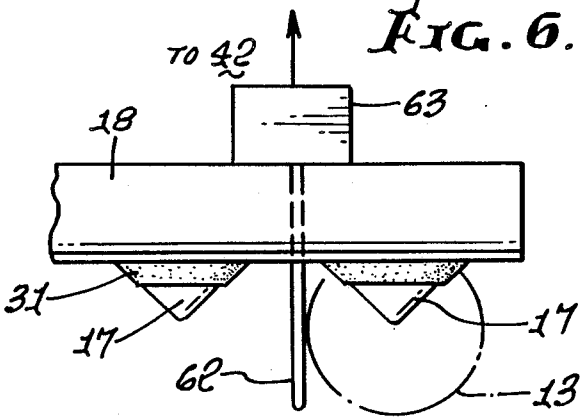
FIG. 6 is a view like FIG. 4, showing a modification.

FIG. 6 shows an alternate form of sensor, i.e. a temperature sensor rod 62 projecting adjacent a tip 17. Built-up ice contacts the rod 62 and operates a temperature sensitive switch at 63. The latter is connected to solenoid 42.

Figure 7:
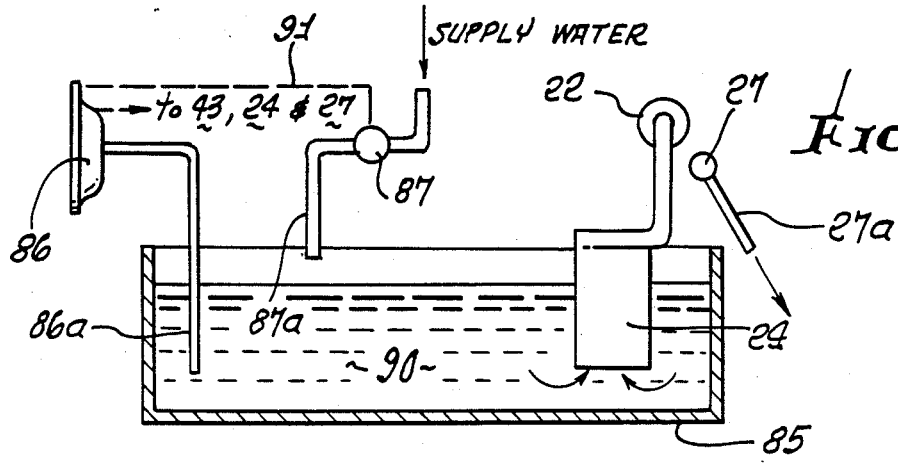
FIG. 7 is a vertical section showing an alternate water supply and a cycle control system.
Figure 2:
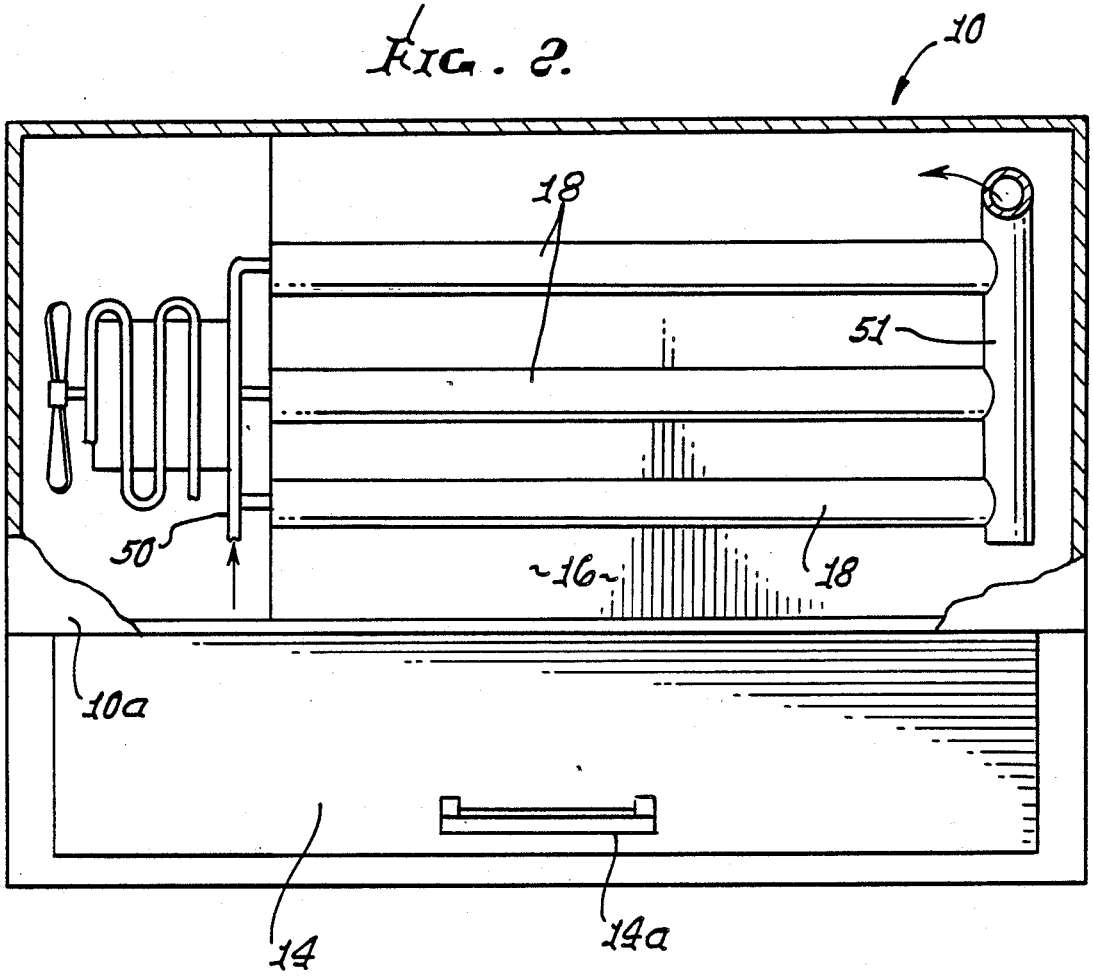
FIG. 2 is a top plan view in section on lines 2—2 of FIG. 1.

FIG. 7 illustrates a means for controlling cycling of the system. As shown, water is supplied to reservoir 85 via a control valve 87, and piping 87*a*. As the level of water 90 in the reservoir (which corresponds to reservoir 23) rises, its level is sensed by pressure switch 86. (Pressure sensing means 86*a* extends into the reservoir water as shown) when the water level reaches a pre-set upper limit, the switch 86 operates to close valve 87. See signal connection line 91. Also, hot gas valve 43 is closed, and pump 24 is energized. As water is pumped from the reservoir 85, ice is formed, as at 13 in FIG. 1.

Water level then drops in the reservoir, and reaches a pre-set lower limit sensed by pressure switch 86. Switch 86 then operates flush valve 27 to open condition, so that water pumped from the reservoir flows to drain via duct 27*a*. Also, hot gas valve 43 is opened, as in the water supply valve 87. Once the evaporator is cleared of ice, rising temperature in the space 19 triggers a sensor 96 (see FIG. 1), which in turn transmits signals to close drain valve 27 and shut down the pump. (Note that reservoir water 90 is flushed out while valve 27 remained open and pump 27 operated). Water level in the reservoir then rises, to repeat the cycle.

I claim:

1. In ice making apparatus, the combination comprising (a) a plate forming a plurality of through openings, the plate having an under surface facing downwardly, (b) a plurality of thermal tips projecting downwardly from said openings, said tips consisting of heat conductive metal, and tapering downwardly to provide downwardly tapering outer surfaces, (c) there being downwardly extending thermal isolator non-metallic surfaces surrounding upper surfaces of the tips, proximate the plate, said isolator surfaces tapering downwardly toward the tip tapered surfaces to permit water drainage over said isolator surfaces onto downwardly tapering metal surfaces of the tips, (d) first means for supplying refrigerant fluid to extract heat from at least some of the tips, via said openings, and thereby cool them to ice forming temperature, (e) second means including spray head means to spray water onto said under surface of the plate between the tips to drain down said isolator surfaces onto the tips, whereby ice progressively forms on the tips below the plate, and the tips may be heated to effect release of the ice from the tips to drop downwardly, for harvesting, said second means including water reservoir means, and means to supply water to said reservoir means and to deliver water from the reservoir means to the spray head means, under the control of water level sensor means for sensing water level in the reservoir means.

2. The combination of claim 1 wherein said tips are integral with said plate, said first means including ducting positioned to extend over said tips so that said refrigerant flows in heat extracting relation with said tips.

3. The combination of claim 2 wherein the tips are hollow and open upwardly to receive said refrigerant from the ducting.

4. The combination of claim 1 wherein the downwardly extending isolator surfaces taper closely about the tips, above the lowermost extents thereof.

5. The combination of claim 2 wherein said first means includes a system to alternately flow cold refrigerant and warm fluid to and through said ducting, the warm fluid heating the tips to release ice that forms on the tips when refrigerant flows through the ducting.

6. The combination of claim 1 wherein the tips are formed in rows and columns on the plate, and are integral therewith.

7. The combination of claim 1 wherein said second means comprises a spray head located beneath said plate, and angled to direct the spray laterally and upwardly to impinge upon plate extents between the tips.

8. The combination of claim 7 including a chute located beneath the tips to receive the ice dropping off the tips and to direct the received ice toward a lower collection zone, and a housing extending about the ducting, plate, chute and said collection zone.

9. In ice making apparatus, the combination comprising (a) a plate forming a plurality of through openings, the plate having an under surface facing downwardly, (b) a plurality of thermal tips projecting downwardly from said openings, said tips consisting of heat conductive metal, (c) there being downwardly extending thermal isolator surfaces surrounding the tips proximate the plate, (d) first means for supplying refrigerant fluid to extract heat from at least some of the tips and thereby cool them to ice forming temperature, (e) and second means to spray water onto said under surface of the plate to drain down said isolator surfaces onto the tips, whereby ice progressively forms on the tips below the plate, and the tips may be heated to effect release of the ice from the tips to drop downwardly, for harvesting, said second means comprising a spray head located beneath said plate, and angled to direct the spray laterally and upwardly to impinge upon plate extents between the tips, (f) said second means including a water reservoir from which water is supplied to the spray head, and including control means to control the amount of water supplied to the reservoir, (g) said second means also including a pump to pump water from the reservoir for supply to the spray head, and a water supply valve, the control means including a first sensor to sense water level in the reservoir, to close said supply valve and start said pump when the water level reaches a pre-set upper limit in the reservoir, and to open said supply valve when the water level drops to a pre-set lower limit, the pump continuing to operate to flush water from the reservoir during removal of ice from the tips.

10. The combination of claim 9 including a flush valve which is open during flushing of water from the reservoir, there being a sensor to sense rising temperature above said plate and controlling the flush valve and pump.

* * * * *